US010639927B2

(12) United States Patent
Kim et al.

(10) Patent No.: US 10,639,927 B2
(45) Date of Patent: May 5, 2020

(54) KNOCK TYPE PEN

(71) Applicant: DONG-A PENCIL CO., LTD., Seoul (KR)

(72) Inventors: Hakjae Kim, Seoul (KR); Jung-gul An, Daejeon (KR)

(73) Assignee: DONG-A PENCIL CO., LTD., Seoul (KR)

( * ) Notice: Subject to any disclaimer, the term of this patent is extended or adjusted under 35 U.S.C. 154(b) by 0 days.

(21) Appl. No.: 16/200,752

(22) Filed: Nov. 27, 2018

(65) Prior Publication Data

US 2019/0344604 A1 Nov. 14, 2019

(30) Foreign Application Priority Data

May 8, 2018 (KR) ..... 10-2018-0052346

(51) Int. Cl.
*B43K 24/08* (2006.01)
*B43K 25/02* (2006.01)
*B43K 7/12* (2006.01)

(52) U.S. Cl.
CPC ..... *B43K 24/08* (2013.01); *B43K 7/12* (2013.01); *B43K 25/02* (2013.01)

(58) Field of Classification Search
CPC ..... B43K 24/00; B43K 24/02; B43K 24/08; B43K 24/082; B43K 24/084; B43K 7/005; B43K 7/12
USPC ..... 401/81, 83
See application file for complete search history.

(56) References Cited

U.S. PATENT DOCUMENTS 364,916 A * 6/1887 Goldsmith ..... B43K 29/02 401/52
1,063,189 A * 6/1913 Dutton ..... B43K 21/08 401/62
2,088,899 A * 8/1937 Chevreau ..... A45D 40/02 401/62
3,679,317 A * 7/1972 Larson ..... B43K 24/084 401/109
4,976,561 A * 12/1990 Kageyama ..... B43K 24/06 401/74
4,991,988 A * 2/1991 Snell ..... B43K 24/084 401/109
6,761,495 B1 * 7/2004 Wu ..... B43K 24/02 401/111
7,331,730 B2 * 2/2008 Fukui ..... B43K 5/17 401/108

(Continued)

FOREIGN PATENT DOCUMENTS

KR 20-2016-0003130 9/2016

*Primary Examiner* — David P Angwin
*Assistant Examiner* — Bradley S Oliver

(57) ABSTRACT

Disclosed is a knock-type pen, which includes: a housing having a '¬'-shaped guide groove formed at a top end thereof; a pen seam accommodated in the housing; a pressing member having a moving protrusion provided at a lower end thereof and movably inserted into the guide groove; a rotating member rotatably coupled to an outer circumference of the top end of the housing and having a 'l'-shaped slide groove into which an end of the moving protrusion inserted into the guide groove is movably inserted; and a knock unit disposed between the pressing member and the pen seam and configured to allow an end of the pen seam to move in and out at a lower end of the housing when the pressing member is pressed.

6 Claims, 6 Drawing Sheets

(56) References Cited

U.S. PATENT DOCUMENTS

| | | | | |
|---|---|---|---|---|
| 10,293,630 | B2 * | 5/2019 | Shawki | B43K 7/005 |
| 10,343,445 | B2 * | 7/2019 | Wu | B43K 7/12 |
| 10,377,166 | B2 * | 8/2019 | Kim | B43K 24/084 |
| 2019/0160852 | A1 * | 5/2019 | Kim | B43K 24/04 |
| 2019/0160854 | A1 * | 5/2019 | Kim | B43K 24/082 |

* cited by examiner

< Prior Art >

< Prior Art >

< Prior Art >

< Prior Art >

< Prior Art >

KNOCK TYPE PEN

CROSS-REFERENCE TO RELATED APPLICATION

This application claims priority of Korean Patent Application No. 10-2018-0052346, filed on May 8, 2018, in the KIPO (Korean Intellectual Property Office), the disclosure of which is incorporated herein entirely by reference.

BACKGROUND OF THE INVENTION

Field of the Invention

The present disclosure relates to a knock-type pen, and more particularly, to a knock-type pen for restraining pressing of a knock when the pen is not in use so that a pen point is not protruded out due to unintended knock pressing.

Description of the Related Art

In general, a pen may be classified into a fixed pen in which a pen seam is fixed and an opening/closing cap is used to expose or hide a pen point, a rotary pen in which a shaft is partially rotated to move a pen seam linearly so that a pen point moves in or out, a knock-type pen in which a shaft is partially pressed to move a spring so that a pen point moves out, and a sliding pen in which a pen slides so that a pen seam protrudes or is immersed.

Among them, the knock-type pen is convenient because the pen point may be easily moved in and out by an operation for pressing a button unit provided at a top end of a housing. If the button unit provided at the top end of the housing is pressed once, the pen point protrudes, so the knock-type pen comes into a writable state. If the button unit is pressed once again, the protruded pen point retracts into the housing, thereby coming into an accommodated and protected state.

FIGS. 1A and 1B are a cross-sectioned view showing a conventional knock-type pen and an exploded view showing a knock tool of the conventional knock-type pen. Referring to FIGS. 1A and 1B, in the conventional knock-type pen 10, a pen seam 12 storing ink is received in a housing 11, and a knock body 15 manipulated to move up and down is protrusively coupled to a slot (not shown) formed at an inner wall of the housing 11. In addition, a rotary cam 16 is rotatably disposed between the pen seam 12 and the knock body 15, and the knock body 15 and the rotary cam 16 form a knock tool 14 that allows the pen seam 12 to move in and out.

Moreover, a spring 21 is disposed between the housing 11 and the pen seam 12 to apply an elastic force to the pen seam 12 in a direction along which a pen point 13 retracts into the housing 11. If a user presses a button unit 17 of the knock body 15, which protrudes out of the housing 11, the pen seam 12 descends so that the pen point 13 protruding at an end thereof protrudes out of the housing 11. At this time, a guide protrusion 20 of the rotary cam 16 in contact with a tooth protrusion 18 at a lower portion of the knock body 15 moves out of the slot of the housing 11 and simultaneously moves out of an inclined surface at one side of the tooth protrusion 18 to rotate along an inclined surface at the other side of the tooth protrusion 18. The rotating guide protrusion 20 of the rotary cam 16 is caught by a stopper 19 protruding on an outer circumference of the knock body 15. In this state, the pen seam 12 is not lifted up despite the elastic force of the spring 21 coupled to the pen point 13, so that the pen point 13 keeps protruding out of the housing 11. If the user presses the button unit 17 again in a state where the pen point 13 is protruding, the rotary cam 16 rotates in the same manner as described above and the guide protrusion 20 of the rotary cam 16 is positioned between the stopper 19 and the stopper 19 of the knock body 15 to move up by the elastic force of the spring 21 so that the pen point 13 enters into the housing 21.

However, if the conventional knock-type pen configured as above is stored in a pocket or on cloth by a clip 22 provided at a top end side of the housing 11 as shown in FIGS. 2A and 2B or stored in a bag or the like as shown in FIG. 2C, the pen point 13 may protrude out due to an unintentional knock pressing or the like, so the ink may flow out through the protruding pen point 13 to cause ink stains to the cloth or bag.

In particular, recently, many knock-type pens having a low-viscosity ink of 300 to 3,000 cps have been released to enable easy writing with a small force (pressure). However, since the low-viscosity ink has a low viscosity, a larger amount of ink flows out through the pen point compared with the high-viscosity ink of 10,000 to 25,000 cps. Moreover, since the low-viscosity ink is easily absorbed, when the pen point protrudes due to unintentional knock pressing or the like, greater ink stains are generated on the cloth or bag, thereby increasing the damage.

SUMMARY OF THE INVENTION

The present disclosure is designed to solve the above problems, and the present disclosure is directed to providing a knock-type pen configured to restrain the pressing of a knock while a pen is not in use, so as to prevent an ink from adhering to cloth or bag through a pen point protruding outward due to unintentional knock pressing.

Meanwhile, other objects not explicitly stated in the present disclosure will be further contemplated to be easily deduced from the following detailed description and the effects thereof.

In one aspect of the present disclosure, there is provided a knock-type pen, comprising: a housing having a '¬'-shaped guide groove formed at a top end thereof; a pen seam accommodated in the housing; a pressing member having a moving protrusion provided at a lower end thereof and movably inserted into the guide groove, the pressing member rotating and moving up and down inside the housing along the guide groove in a state where a top end protrudes from the top end of the housing; a rotating member rotatably coupled to an outer circumference of the top end of the housing and having a 'l'-shaped slide groove into which an end of the moving protrusion inserted into the guide groove is movably inserted; and a knock unit disposed between the pressing member and the pen seam and configured to allow an end of the pen seam to move in and out at a lower end of the housing when the pressing member is pressed.

Here, the slide groove of the rotating member may be sized to match with a vertical direction of the guide groove.

Moreover, the rotating member may have a clip.

In the knock-type pen according to an embodiment of the present disclosure, the moving protrusion protruding from the pressing member is movably inserted into the guide groove having a '¬' shape and provided at the housing, the moving protrusion is fixed when being disposed at the fixing portion of the guide groove, and thus it is possible to prevent the ink from flowing through the pen point protruding outward due to unintentional pressing of the pressing member to contaminate cloth or bag.

In addition, in the knock-type pen according to an embodiment of the present disclosure, since the moving portion and the fixing portion of the guide groove are divided by means of the slide groove of the rotating member rotatably coupled to the housing, it is possible to prevent the moving protrusion moving up and down along the overlapping region of the slide groove and the moving portion from unexpectedly moving to the fixing portion and thus restraining the pressing of the pressing member.

In particular, when the knock-type pen according to an embodiment of the present disclosure uses a low-viscosity ink having a relatively low viscosity (300 to 3,000 cps) to a high-viscosity ink having a high viscosity (10,000 to 25,000 cps), it is possible to prevent the ink from flowing out from the pen point due to the knock pressing or the like and thus prevent ink stains from being generated on cloth or bag. The present disclosure may be applied to any kind of writing instrument like ball pens using a low-viscosity ink and a high-viscosity ink.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

Figure 1A:
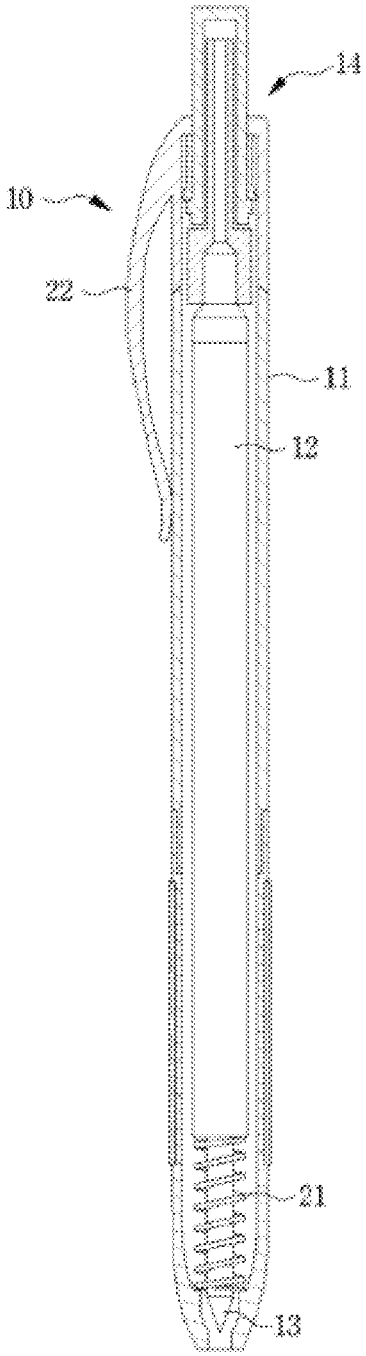
FIG. 1A is a cross-sectioned view showing a conventional knock-type pen.
Figure 1B:
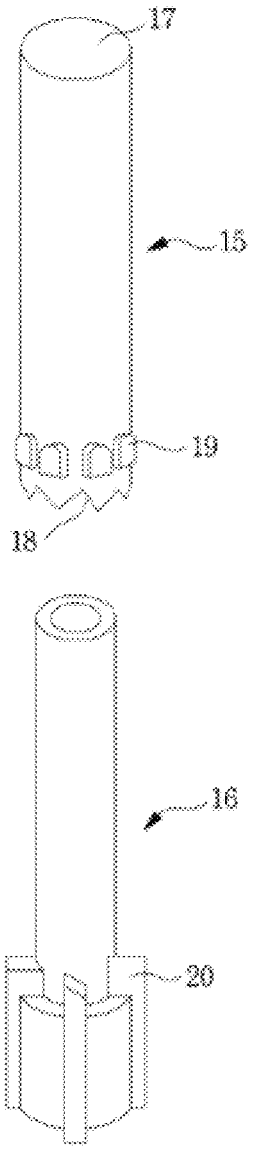
FIG. 1B is an exploded perspective view showing a knock tool of the conventional knock-type pen.
Figure 2A:
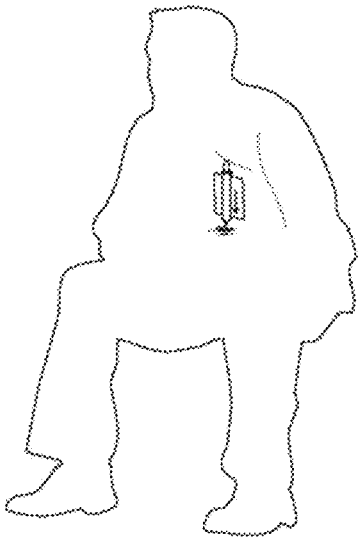
FIGS. 2A and 2B are diagrams showing a state where a button unit of a knock-type pen is pressed so that an ink flows out to make a stain on an upper garment, when a user sticks the knock-type pen to the upper garment and store thereon.
Figure 2B:
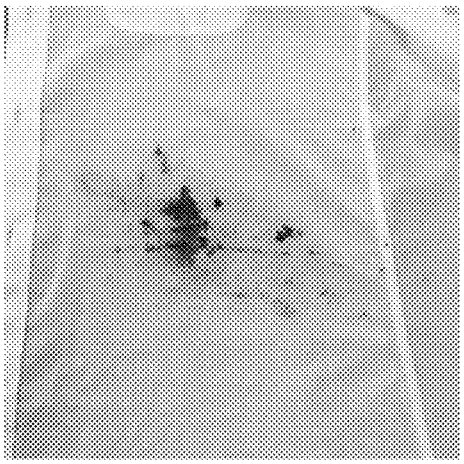
Figure 2C:
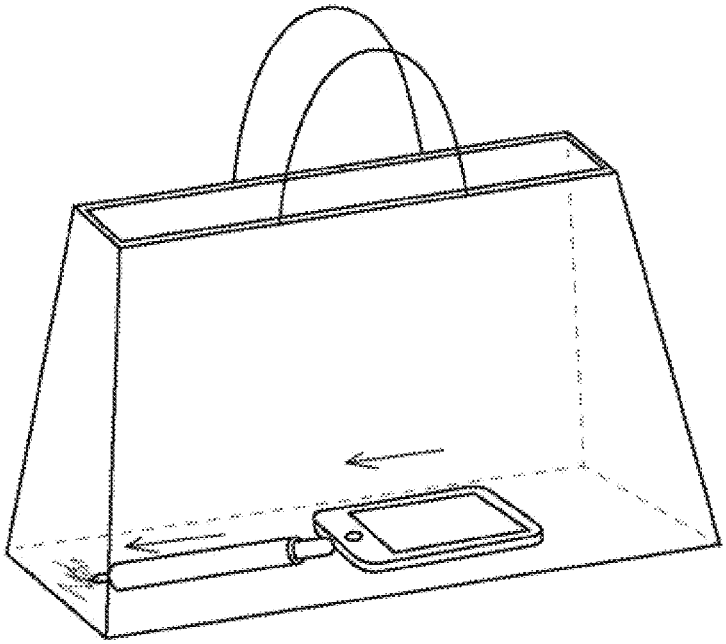
FIG. 2C is a diagram showing a state where the button unit of the knock-type pen is pressed so that an ink flows out to contaminate the inside of a bag, when a user stores the knock-type pen in the bag.

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Reference herein to a layer formed "on" a substrate or other layer refers to a layer formed directly on top of the substrate or other layer or to an intermediate layer or intermediate layers formed on the substrate or other layer. It will also be understood by those skilled in the art that structures or shapes that are "adjacent" to other structures or shapes may have portions that overlap or are disposed below the adjacent features.

In this specification, the relative terms, such as "below", "above", "upper", "lower", "horizontal", and "vertical", may be used to describe the relationship of one component, layer, or region to another component, layer, or region, as shown in the accompanying drawings. It is to be understood that these terms are intended to encompass not only the directions indicated in the figures, but also the other directions of the elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

Figure 3A:
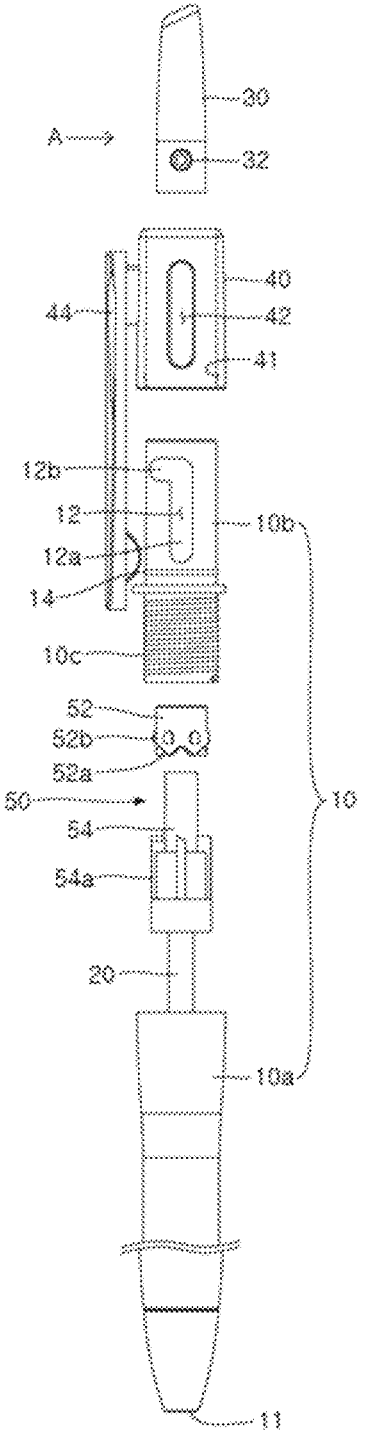
FIG. 3A is an exploded view showing a knock-type pen according to an embodiment of the present disclosure.
Figure 3B:
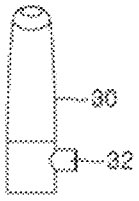
FIG. 3B is a diagram showing a pressing member according to an embodiment of the present disclosure, observed in a direction A.
Figure 4:
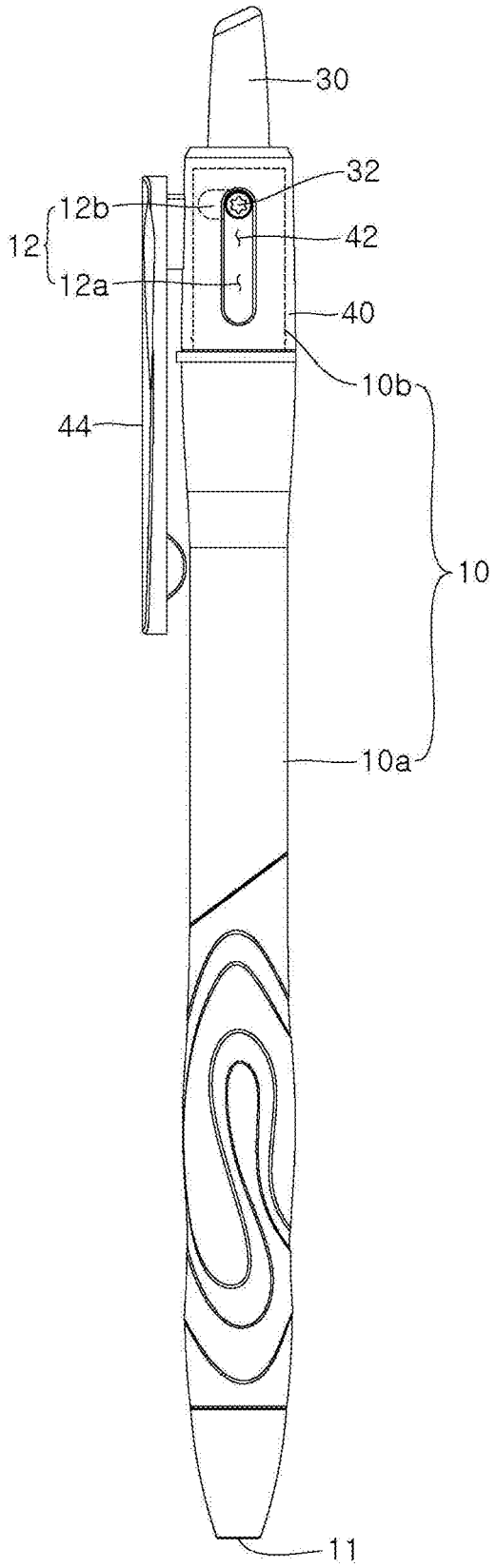
FIGS. 4 to 6 are side views for illustrating the operation of the knock-type pen according to an embodiment of the present disclosure.
Figure 5:
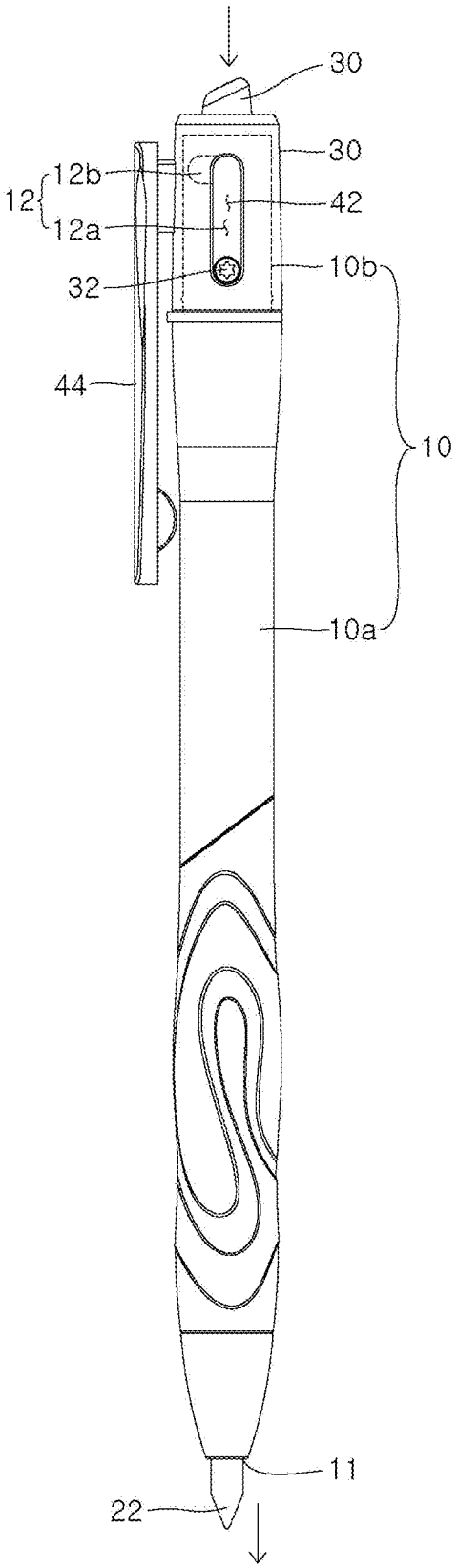
Figure 6:
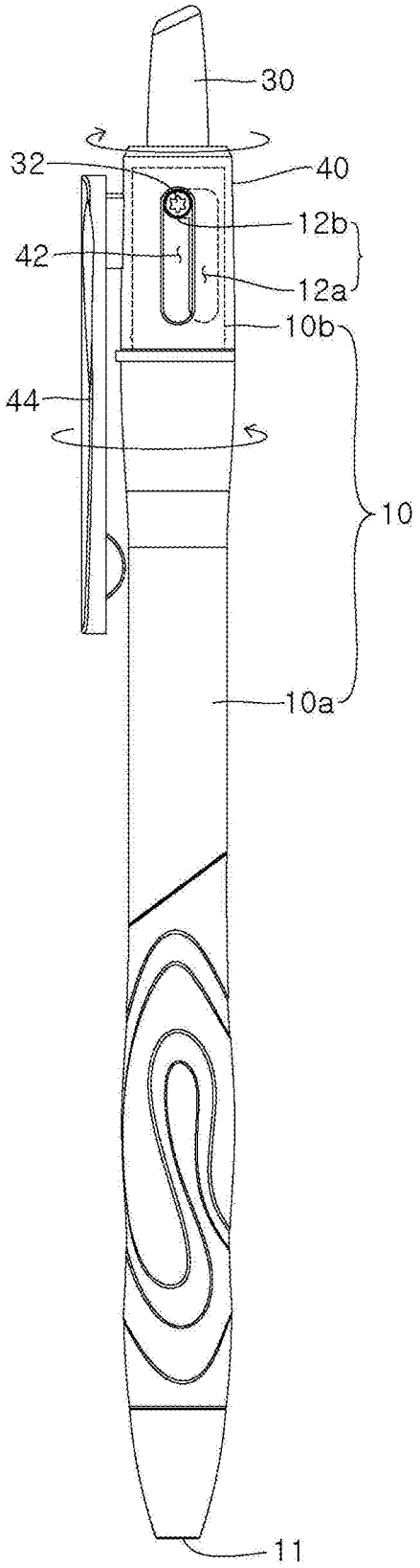

Referring to FIGS. 3A and 3B, a knock-type pen according to an embodiment of the present disclosure includes a housing 10 having a guide groove 12 formed at a top end thereof, a pen seam 20 accommodated in the housing 10, a pressing member 30 having a moving protrusion 32 provided at a lower end thereof and inserted into the guide groove 12, a rotating member 40 rotatably coupled to the top end of the housing 10 and having a slide groove 42 into which the moving protrusion 32 is inserted, and a knock unit 50 disposed between the pressing member 30 and the pen seam 20 and configured to allow an end of the pen seam 20 to move in and out at a lower end of the housing 10 when the pressing member 30 is pressed.

Referring to FIGS. 3A to 6, the housing 10 has a hollow shape with both ends open. The pen seam 20, the pressing member 30 and the knock unit 50 are accommodated in the housing 10, and the rotating member 40 is rotatably coupled to an outer circumference at the top end of the housing 10.

The guide groove 12 perforated in a '¬' shape is formed at one side of the top end of the housing 10. The housing 10 may be divided into two or more objects to facilitate assembly and disassembly, and this embodiment will be described based on the case where the housing 10 is divided into two objects, namely a lower housing 10*a* and an upper housing 10*b*. Meanwhile, in this embodiment, it is depicted that the housing is divided so that the length of the lower housing 10*a* is longer than the length of the upper housing 10*b*. However, this is just an embodiment, and the present disclosure is not limited thereto. The length of the upper housing 10*b* may be longer than that of the lower housing 10*a*. Also, the lower housing 10*a* and the upper housing 10*b* are connected by screwing.

An inlet 11 having an open form is provided at a lower end of the lower housing 10*a*, and an end of the pen seam 20, namely a pen point 22, accommodated in the housing 10 moves in and out through the inlet 11. The guide groove 12 described above is provided at the top end of the upper housing 10*b*. Also, a convex portion 14 protrudes along the outer circumference of the top end of the upper housing 10*b*, and the convex portion 14 is provided below the lower end of the guide groove 12. The convex portion 14 is coupled by being fitted into the concave portion 41 inside the rotating member 40. The rotating member 40 is firmly fixed to the upper housing 10*b* as the concave portion 41 therein is coupled to the convex portion 14 of the upper housing 10*b*.

The guide groove 12 is formed by perforating at one side of the top end of the upper housing 10*b* in the vertical direction and in the transverse direction. The guide groove 12 is formed generally in a '¬' shape. The guide groove 12 includes a moving portion 12*a* extending in the vertical direction and a fixing portion 12*b* bent from the top end of the moving portion 12*a* and extending in the transverse direction. Meanwhile, in this embodiment, it is depicted that the fixing portion 12*b* in the transverse direction is perpendicular to the moving portion 12*a* in the vertical direction. However, this is just an embodiment, and the present disclosure is not limited thereto. The fixing portion 12*b* may also extend in a diagonal direction from the moving portion 12*a*. At this time, it should be understood that if the fixing portion 12*b* extends in a diagonal direction from the top end of the moving portion 12*a* at an angle of 45 degrees or less, the diagonal direction falls within the scope of the transverse direction.

As described later, if the moving protrusion 32 of the pressing member 30 is positioned at the moving portion 12*a* of the guide groove 12, the moving protrusion 32 may freely move up and down and the pressing member 30 may be freely pressed, and thus it is not limited that the pen point 22 moves in and out. However, if the moving protrusion 32 is positioned at the fixing portion 12*b* of the guide groove 12, the position of the moving protrusion 32 is fixed, and thus it is restrained that the pressing member 30 is pressed, thereby preventing the pen point 22 from moving in and out. By restraining the pressing of the pressing member 30, it is possible to prevent the pen point 22 from protruding to the outside due to unintentional pressing of the pressing member 30 by the user and thus prevent the ink from flowing out through the protruding pen point 22 to contaminate cloth or bag.

The lower end of the pressing member 30 is inserted into the top end of the upper housing 10*b*, and the top end is protruded from the open top end of the upper housing 10*b*. The moving protrusion 32 protrudes at the lower end of the pressing member 30, and the moving protrusion 32 preferably protrudes in a direction perpendicular to the longitudinal direction of the pressing member 30. The moving protrusion 32 is made in a round bar form. The lower end of the moving protrusion 32 provided at the lower end of the pressing member 30 is movably inserted into the guide groove 12 provided at the inner side of the top end of the upper housing 10*b*, and thus the moving protrusion 32 is movably inserted into the guide groove 12 provided at the top end of the upper housing 10*b*.

The rotating member 40 has a hollow shape with both ends open. The rotating member 40 is coupled to surround the outer circumference of the top end of the upper housing 10*b* and simultaneously is rotatably provided at the outer circumference of the top end of the upper housing 10*b*. A 'l'-shaped slide groove 42 perforated along the vertical direction is provided at one side of the rotating member 40. An end of the moving protrusion 32 inserted into the guide groove 12 is movably inserted into the slide groove 42 of the rotating member 40 that is fastened to the top end of the upper housing 10*b*.

That is, the moving protrusion 32 of the pressing member 30 is disposed at the overlapping region of the slide groove 42 and the guide groove 12 to be movable vertically or fixed. Specifically, if the slide groove 42 and the moving portion 12*a* of the guide groove 12 are overlapped by the left and right rotation of the rotating member 40, the moving protrusion 32 may move up and down freely. Also, if the slide groove 42 and the fixing portion 12*b* of the guide groove 12 are overlapped, the moving protrusion 32 is fixed to the fixing portion 12*b* to restrain that the pressing member 30 is pressed.

In the knock-type pen according to an embodiment of the present disclosure, since the moving portion 12*a* and the fixing portion 12*b* of the guide groove 12 are divided through the slide groove 42, it is possible to prevent the problem that the moving protrusion 32 moving up and down along the overlapping region of the slide groove 42 and the moving portion 12*a* moves to the fixing portion 12*b* unintentionally to restrain that the pressing member 30 is pressed.

In addition, if the rotating member 40 is rotated in a state where the moving protrusion 32 is positioned at the top end of the overlapping region of the slide groove 42 and the moving portion 12*a*, the moving protrusion 32 moves in the transverse direction along the rotating member 40 and the fixing portion 12*b* and is disposed at the overlapping region of the slide groove 42 and the fixing portion 12*b*, thereby fixing the location of the moving protrusion 32.

Moreover, the slide groove 42 intermittently overlapping with the moving portion 12*a* and the fixing portion 12*b* of the guide groove 12 due to the left and right rotation of the rotating member 40 is preferably manufactured with a size equal to or slightly smaller than the moving portion 12*a* in order to accurately divide the moving portion 12*a* and the fixing portion 12*b*. At this time, it is most preferable that the slide groove 42 is made to have the same size as the moving portion 12*a* so as to be matched with the moving portion 12*a* when the slide groove 42 is overlapped with the moving portion 12*a*.

A clip 44 is provided at an outer side of the rotating member 40. The clip 44 may be used to put the pen into a pocket or paper. However, the clip 44 may also be used as a handle for rotating the rotating member 40 as described above.

Referring to FIGS. 3A and 3B, the knock unit 50 is disposed between the pressing member 30 and the pen seam 20 and operates to allow an end of the pen seam 20, namely the pen point 22, to move in and out through the inlet 11 at the bottom of the housing 10 when the pressing member 30 is pressed.

The knock unit 50 includes a knock member 52 and a rotary cam 54. The knock member 52 is disposed inside the housing 10 to be movable up and down, and the pressing member 30 is connected to the top end of the knock member 52. At this time, the knock member 52 and the pressing member 30 may be integrally formed. Teeth 52*a* are provided at a lower end of the knock member 52, and the teeth 52*a* contact a guide protrusion 54*a* of the rotary cam 54. The top end of the pen seam 20 is fitted into the lower end of the rotary cam 54. The rotary cam 54 is rotatably disposed inside the housing 10, and the guide protrusion 54*a* is formed at the rotary cam 54 to contact the teeth 52*a* of the knock member 52.

The configuration and operation of the knock unit 50 is not an essential feature of the present disclosure and is not described in detail here since it a well-known technology as described in detail in the Background section of the specification.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A knock-type pen, comprising:

a housing having a '¬'-shaped guide groove formed at a top end thereof;

a pen seam accommodated in the housing;

a pressing member having a moving protrusion provided at a lower end thereof and movably inserted into the guide groove, the pressing member rotating and moving up and down inside the housing along the guide groove in a state where a top end protrudes from the top end of the housing;

a rotating member rotatably coupled to an outer circumference of the top end of the housing and having a 'l'-shaped slide groove into which an end of the moving protrusion inserted into the guide groove is movably inserted; and a knock unit disposed between the pressing member and the pen seam and configured to allow an end of the pen seam to move in and out at a lower end of the housing when the pressing member is pressed.

2. The knock-type pen of claim 1, wherein the slide groove of the rotating member is sized to match with a vertical direction of the guide groove.

3. The knock-type pen of claim 2, wherein the rotating member has a clip.

4. A knock-type pen, comprising:

a housing having a '¬'-shaped guide groove formed at a top end thereof;

a pen seam accommodated in the housing;

a pressing member having a moving protrusion provided at a lower end thereof and movably inserted into the guide groove;

a rotating member rotatably coupled to an outer circumference of the top end of the housing and having a 'l'-shaped slide groove into which an end of the moving protrusion inserted into the guide groove is movably inserted; and a knock unit disposed between the pressing member and the pen seam.

5. The knock-type pen of claim 4, wherein the slide groove of the rotating member is sized to match with a vertical direction of the guide groove.

6. The knock-type pen of claim 4, wherein the rotating member has a clip.

* * * * *